US008276752B1

(12) United States Patent
Meng

(10) Patent No.: US 8,276,752 B1
(45) Date of Patent: Oct. 2, 2012

(54) TOOL BOX

(76) Inventor: Ji-Fen Meng, Taichung (TW)

( * ) Notice: Subject to any disclaimer, the term of this patent is extended or adjusted under 35 U.S.C. 154(b) by 0 days.

(21) Appl. No.: 13/437,012

(22) Filed: Apr. 2, 2012

(51) Int. Cl.
*B65D 85/28* (2006.01)

(52) U.S. Cl. ..... 206/372; 206/1.5

(58) Field of Classification Search ..... 206/349, 206/372, 373, 374, 375, 376, 1.5, 234
See application file for complete search history.

(56) References Cited

U.S. PATENT DOCUMENTS 4,548,193 A * 10/1985 Marogil ..... 126/30
6,062,385 A * 5/2000 Cho ..... 206/373
6,648,166 B2 * 11/2003 Levy ..... 220/520
6,662,945 B1 * 12/2003 Chang ..... 206/372
7,306,099 B2 * 12/2007 Chen ..... 206/379
2002/0117413 A1 * 8/2002 Ling ..... 206/373
2005/0077198 A1 * 4/2005 Wikle et al. ..... 206/373
2005/0161357 A1 * 7/2005 Allan et al. ..... 206/373
2006/0091032 A1 * 5/2006 Tsai ..... 206/373
2008/0035510 A1 * 2/2008 Brunson ..... 206/373
2010/0320108 A1 * 12/2010 Riedel et al. ..... 206/372

* cited by examiner

*Primary Examiner* — Jacob K Ackun

(57) ABSTRACT

A tool box includes a box formed by top and bottom covers, in which the two covers are pivoted with each other so that the box can open or close; a lock member, in which one end of the lock member is pivoted on the bottom cover and another end of the lock member is used to lock with the top cover; and two handles disposed on top and bottom covers respectively. If the box is unlocking, the handle on the bottom cover is blocked by the lock member and the handle is not allowed to be bent up. Consequently, a user will be aware that the box is unlocking.

5 Claims, 5 Drawing Sheets

TOOL BOX

BACKGROUND OF THE INVENTION

1. Field of the Invention

The present invention relates to a tool box, more particularly to a tool box for alerting users whether the tool box is locked or not before the users take it in hands.

2. Description of Related Art

Hand tools are ordinary and widely using in houses and factories. People often assemble and fix things by using various hand tools like wrenches, screwdrivers, hammers . . . etc. Thus, a tool box can make a user more convenient to carry those different hand tools.

A conventional tool box comprises a box, a plurality of rooms in the box for receiving hand tools and bolts, a handle for the user to carry the tool box, a lock member for locking the tool box. However, the user is often unaware whether the lock member locks the tool box or not before the user carries the tool box. Thus, the tool box is opening unexpectedly when the lock member does not lock the tool box, and all pieces are falling down the ground.

The present invention has arisen to mitigate and/or obviate the disadvantages of the conventional.

SUMMARY OF THE INVENTION

The main objective of the present invention is to provide an improved tool box.

To achieve the objective, a tool box comprises a box formed by top and bottom covers, the two covers pivoted with each other so that the box can open or close, the closed box having a slit between the two covers, a lock member, one end of the lock member pivoted on the bottom cover and another end of the lock member across the slit to lock with the top cover, the top cover having a locking hole for the lock member to lock up, two handles, each of the two handles pivoted on a handle room of the cover and at two sides of the slit respectively; wherein when the box is locking up and the two handles are received in the handle rooms, the lock member vertically locates between the two handles; wherein the two handles are bent up for a user to carry when the box is locking up; if the box is unlocking, the handle on the bottom cover is blocked by the lock member and the handle is not allowed to be bent up; thereby the user will be aware that the box is unlocking.

The handles are formed as U-shaped or arc. The bottom cover has a receiving room defined therein, the receiving room having at least one central room and at least one bit holder defined thereon, a plurality of extensible supports linking the receiving room, the central room, and the bit holder together; thereby the receiving room, the central room, and the bit holder are stretched up to form as a stair, or retracted to stack up.

The covers further comprise a transparent window for the user to look into the tool box.

Further benefits and advantages of the present invention will become apparent after a careful reading of the detailed description with appropriate reference to the accompanying drawings.

DETAILED DESCRIPTION OF THE INVENTION

Figure 1:
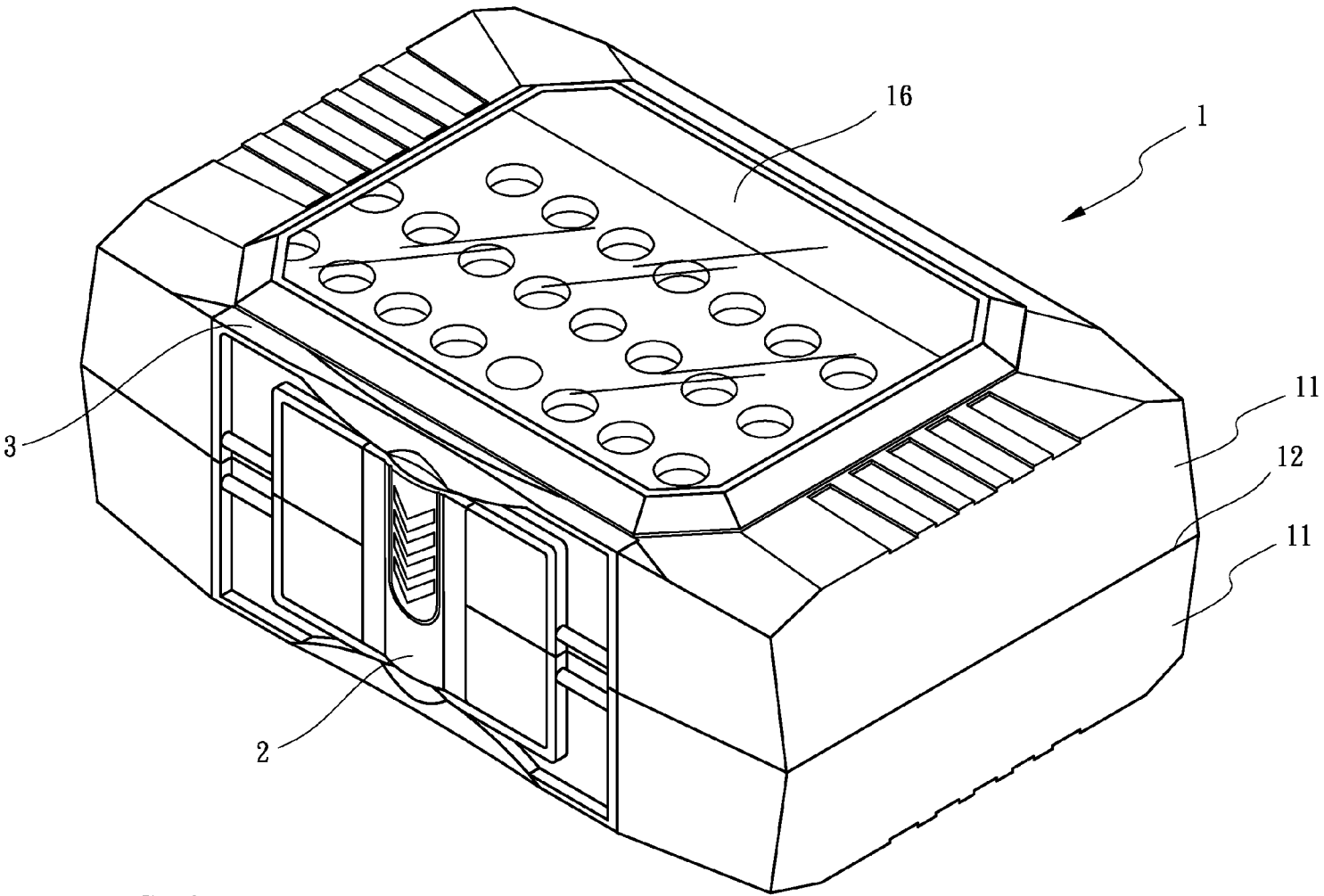
FIG. 1 is a perspective view of a tool box in accordance with the present invention.
Figure 2:
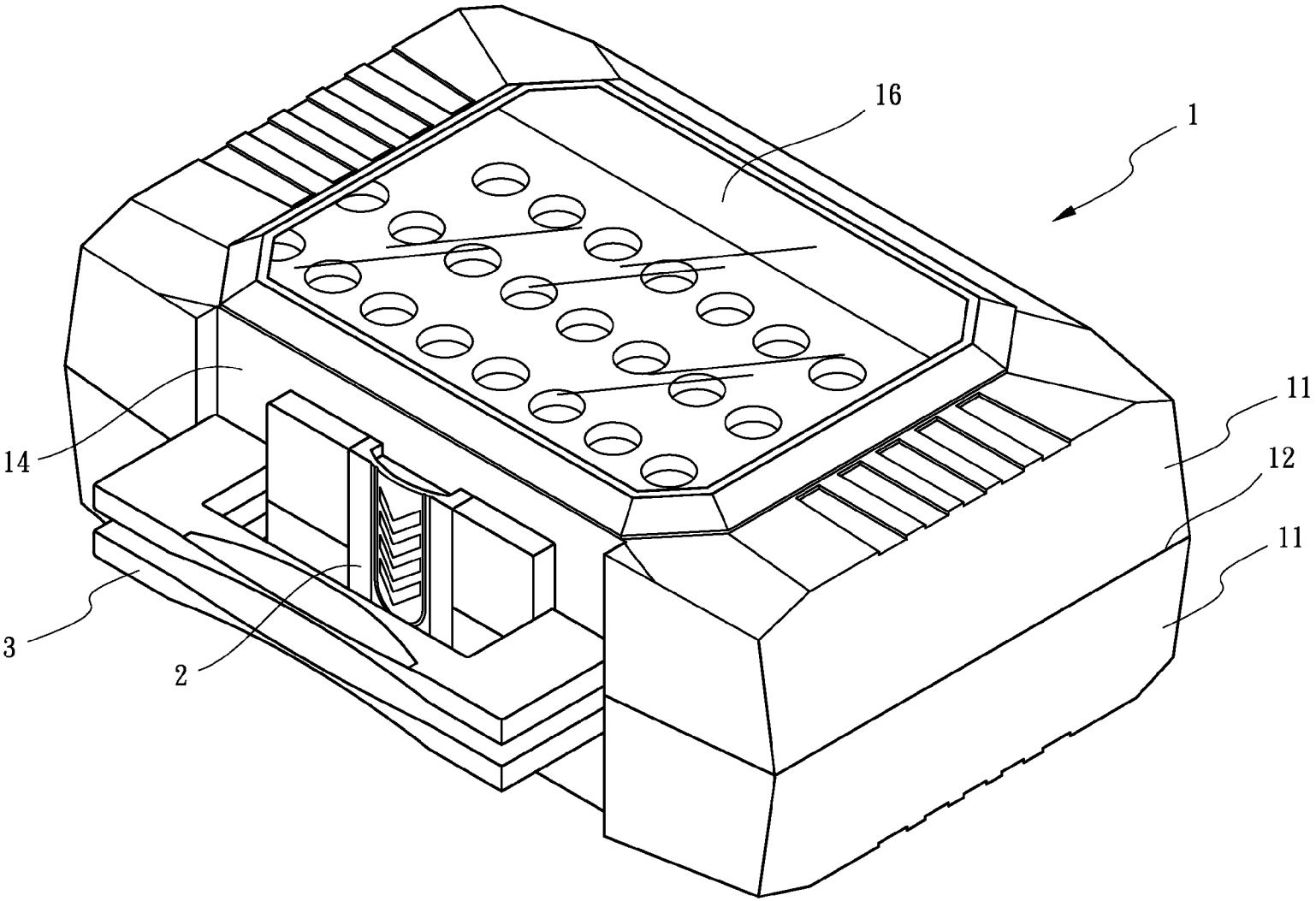
FIG. 2 is a perspective view for showing two handles bent out of handle rooms.
Figure 3:
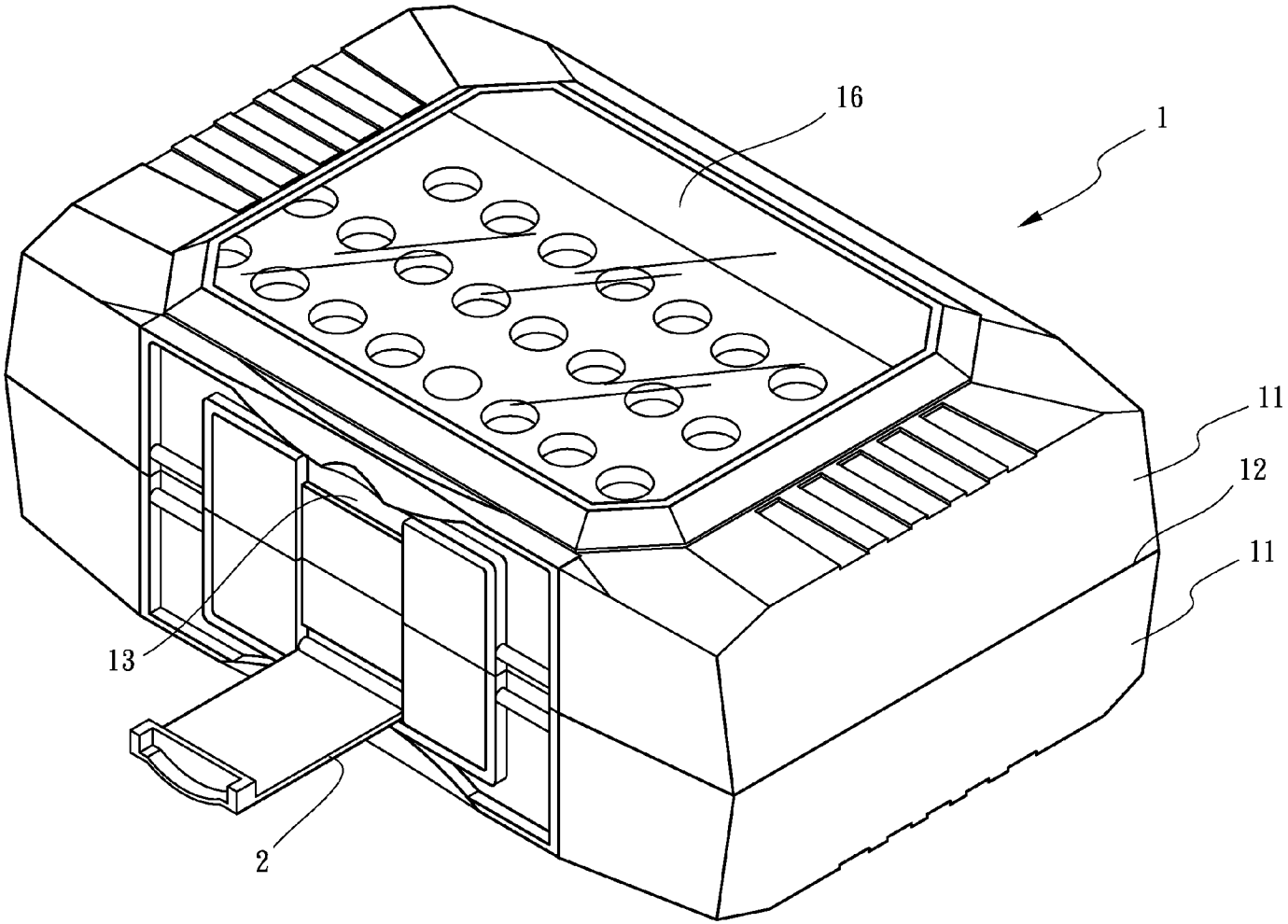
FIG. 3 is a perspective view for showing a lock member in the unlocking situation.

Referring to FIGS. 1-3, a tool box comprises a box 1. The box 1 is formed by two covers 11 (Hereinafter two covers 11 are a top cover 11 and a bottom cover 11 as shown in FIGS. 1-3). The two covers 11 are pivoted with each other so that the box 1 can open or close. The closed box 1 has a slit 12 between the two covers 11.

A lock member 2, one end of the lock member 2 is pivoted on the bottom cover 11 and another end of the lock member 2 is across the slit 12 to lock with the top cover 11. The top cover 11 has a locking hole 13 for the lock member 2 to lock up.

Two handles 3, each of the two handles 3 is pivoted on a handle room 14 of the cover 11 and locates at two sides of the slit 12 respectively. When the box 1 is locking up and the two handles 3 are received in the handle rooms 14, the lock member 2 vertically locates between the two handles 3.

Under this arrangement, the two handles 3 are bent up for a user to carry when the box 1 is locking up. If the box 1 is unlocking, the handle 3 on the bottom cover 11 is blocked by the lock member 2 and the handle 3 is not allowed to be bent up (As shown in FIG. 3). Consequently, the user will be aware that the box 1 is unlocking.

Referring to FIG. 3, if the user wants to carry the unlocking box 1, the handle 3 on the bottom cover 11 cannot be bent up because of the blocking of the lock member 2. In order to carry the box 1, the user must lock up the box 1 at first, and than bend up the two handles 3 for carrying.

Referring to FIGS. 2-3, when the handles 3 are bent up and escape from the handle rooms 14, the handles 3 are easily broken by the bumping from other things. Therefore, when the user wants to put down the box 1, the user should check whether the box 1 is locking or not at first, and then bending down the handles 3 into the handle rooms 14 for safely storing the box 1.

In the present embodiment, the handles 3 are formed as U-shaped or arc, but the handles 3 can be in various shapes dependent on the designers.

Figure 4:
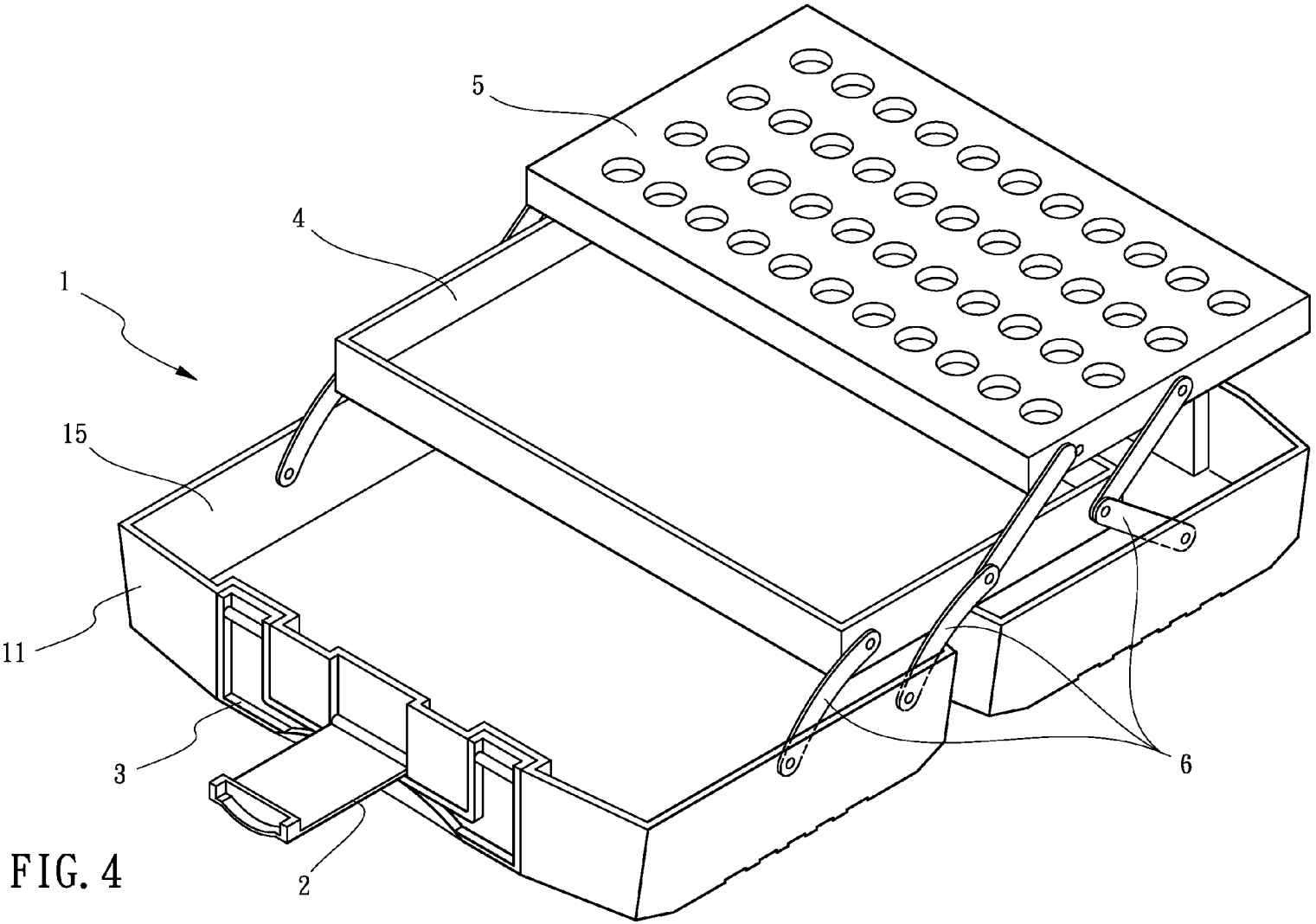
FIG. 4 is a perspective view for showing the opening tool box.
Figure 5:
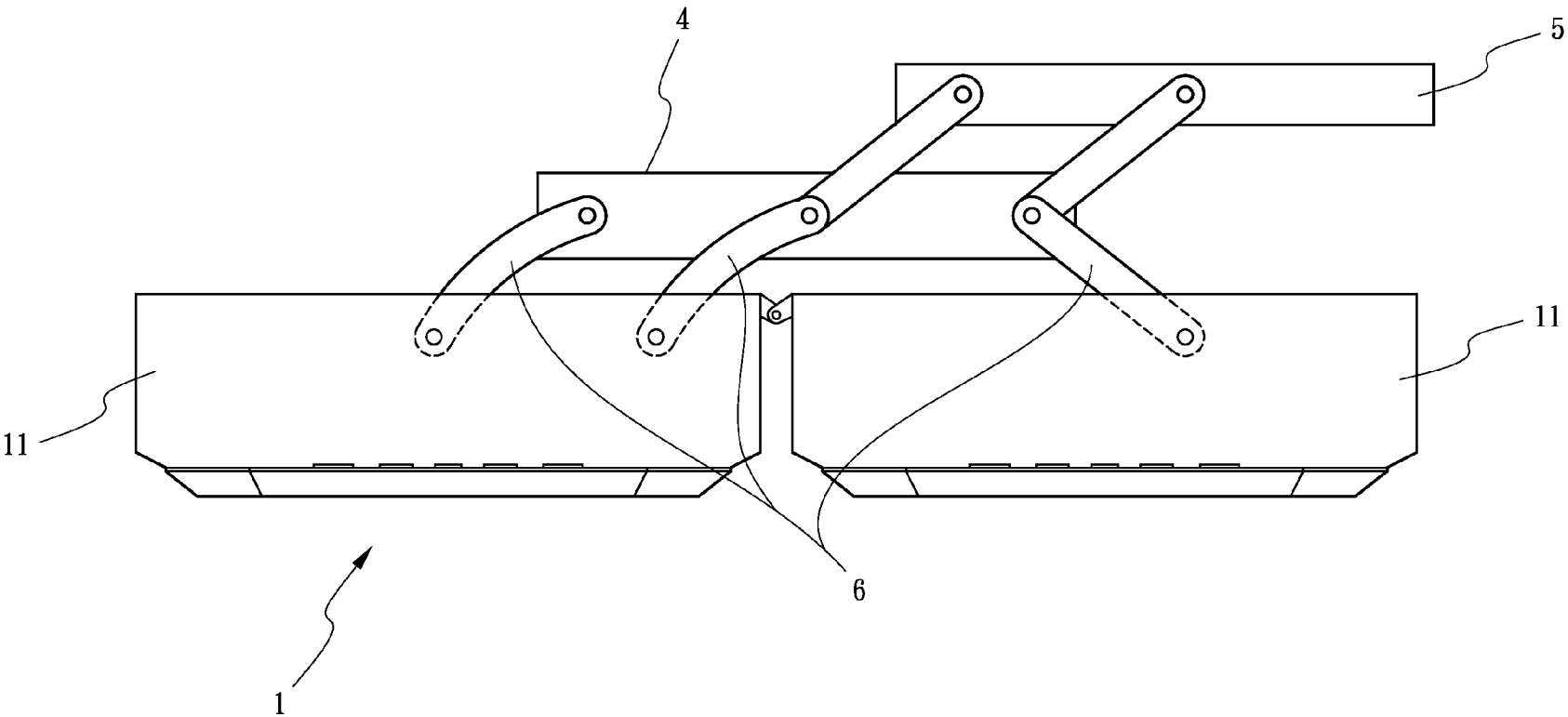
FIG. 5 is a side view for showing the opening tool box.

Referring to FIGS. 4-5, the bottom cover 11 has a receiving room 15 defined therein. The receiving room 15 has at least one central room 4 and at least one bit holder 5 defined thereon. A plurality of extensible supports 6 links the receiving room 15, the central room 4, and the bit holder 5 together. When the box 1 is opening, the extensible supports 6 are stretched up and support the central room 4 and the bit holder 5 above the receiving room 15, so that the opening box 1 is formed as a stair. When the box 1 is closing, the extensible supports 6 retract to stack up the receiving room 15, the central room 4, and the bit holder 5.

The covers 11 further comprise a transparent window 16 for the user to look into the tool box.

Although the invention has been explained in relation to its preferred embodiment, it is to be understood that many other possible modifications and variations can be made without departing from the spirit and scope of the invention as hereinafter claimed.

What is claimed is:

1. A tool box comprising:

a box formed by top and bottom covers, the two covers pivoted with each other so that the box can open or close, the closed box having a slit between the two covers;

a lock member, one end of the lock member pivoted on the bottom cover and another end of the lock member across the slit to lock with the top cover, the top cover having a locking hole for the lock member to lock up; and two handles, each of the two handles pivoted on a handle room of the cover and at two sides of the slit respectively; wherein when the box is locking up and the two handles are received in the handle rooms, the lock member vertically locates between the two handles;

wherein the two handles are bent up for a user to carry when the box is locking up; if the box is unlocking, the handle on the bottom cover is blocked by the lock member and the handle is not allowed to be bent up; thereby the user will be aware that the box is unlocking.

2. The tool box as claimed in claim 1, wherein the handles are formed as U-shaped or arc.

3. The tool box as claimed in claim 1, wherein the bottom cover has a receiving room defined therein, the receiving room having at least one central room and at least one bit holder defined thereon, a plurality of extensible supports linking the receiving room, the central room, and the bit holder together; thereby the receiving room, the central room, and the bit holder are stretched up to form as a stair, or retracted to stack up.

4. The tool box as claimed in claim 2, wherein the bottom cover has a receiving room defined therein, the receiving room having at least one central room and at least one bit holder defined thereon, a plurality of extensible supports linking the receiving room, the central room, and the bit holder together; thereby the receiving room, the central room, and the bit holder are stretched up to form as a stair, or retracted to stack up.

5. The tool box as claimed in claim 1, wherein the covers further comprise a transparent window for the user to look into the tool box.

* * * * *